US010201884B2

(12) United States Patent
Sandefur

(10) Patent No.: US 10,201,884 B2
(45) Date of Patent: Feb. 12, 2019

(54) KNIFE SHARPENING DEVICE

(71) Applicant: Michael Sandefur, Evansville, IN (US)

(72) Inventor: Michael Sandefur, Evansville, IN (US)

( * ) Notice: Subject to any disclaimer, the term of this patent is extended or adjusted under 35 U.S.C. 154(b) by 0 days.

(21) Appl. No.: 15/590,486

(22) Filed: May 9, 2017

(65) Prior Publication Data

US 2017/0320185 A1 Nov. 9, 2017

Related U.S. Application Data

(60) Provisional application No. 62/333,587, filed on May 9, 2016.

(51) Int. Cl.

| | |
|---|---|
| ***B24B 3/54*** | (2006.01) |
| ***B24D 15/08*** | (2006.01) |
| *B24B 3/36* | (2006.01) |
| *B24D 15/06* | (2006.01) |

(52) U.S. Cl.

CPC ..... *B24B 3/543* (2013.01); *B24D 15/081* (2013.01); *B24B 3/36* (2013.01); *B24B 3/54* (2013.01); *B24D 15/06* (2013.01)

(58) Field of Classification Search

CPC ..... B24B 3/54
USPC ..... 451/558, 45, 349; 76/82; 269/3
See application file for complete search history.

(56) References Cited

U.S. PATENT DOCUMENTS

| | | | | |
|---|---|---|---|---|
| 3,432,159 A * | 3/1969 | Rakatansky | ..... | B24B 19/001 15/268 |
| 4,320,892 A * | 3/1982 | Longbrake | ..... | B24B 3/54 269/3 |
| 4,512,112 A * | 4/1985 | Levine | ..... | B24D 15/08 269/3 |
| 5,363,602 A * | 11/1994 | Anthon | ..... | B24D 15/06 451/367 |
| 6,579,163 B1 * | 6/2003 | Ross | ..... | B24B 3/36 451/540 |

* cited by examiner

*Primary Examiner* — Robert Rose
(74) *Attorney, Agent, or Firm* — Oliff PLC; R. Brian Drozd

(57) ABSTRACT

A knife sharpener for the manual sharpening of knives that includes a knife clamp member having first and second clamping members, a guide member that defines upper and lower guide members, and a base member. Each upper and lower guide member includes a plurality of apertures sized and shaped for receiving a guide rod that includes a sharpening stone. The knife clamp member further includes embodiments assuring the knife blade is held securely and positioned between the first and second clamping members in the same position in which the knife blade was installed the last time it was sharpened.

19 Claims, 8 Drawing Sheets

KNIFE SHARPENING DEVICE

CROSS REFERENCES TO RELATED APPLICATIONS

U.S. Provisional Application for Patent No. 62/333,587, filed May 9, 2016, with title "Knife Sharpening Device" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable.

BACKGROUND OF THE INVENTION

1. Field of the Invention

The present invention is related generally to knife sharpeners, and more particularly, the present invention concerns knife sharpeners with clamping members having embodiments to correspond with the knife in order to assure the blade is being held firmly and in an exact repeatable position.

2. Brief Description of Prior Art

Knife sharpeners are known for aiding in the manual sharpening of blades. In one commercially available design, a knife blade is clamped between two clamp members and a sharpening stone is guided along the edge of a blade by a rod member secured to a sharpener stone holder and in communication with a guide member. However, this prior art sharpener clamp has some deficiencies. One major problem is that it is virtually impossible to clamp a knife blade between the two clamp members in the same position on the knife in which the knife was installed the last time it was sharpened. The distance between the guide edges of the flange and the cutting edge of the knife blade may be different. The position of the holder lengthwise of the blade may also be different. The holder may be at a slightly different angle relative to the blade. Even when the difference in the position of the holder from the last sharpening of a particular knife is relatively small, sharpening nonetheless requires grinding a new edge with a different angle to the surface of the blade and removing a relatively large amount of blade material. Consequently, sharpening takes a relatively long time, and each sharpening reduces the life of the blade. This is the general deficiency that the present invention is intended to address.

SUMMARY OF THE INVENTION

A knife sharpener for the manual sharpening of knives. The sharpening device includes a knife clamp member that includes first and second clamping members, a guide member that defines an upper guide member and a lower guide member, and a base member. A clamping member adjustment is used in order to engage the first and second clamping members into a clamping position with the apparatus to be sharpened. The upper guide member upwardly extends from the knife clamp member and the lower guide member downwardly extends from the knife clamp member, the lower guide member in communication with the base. Each upper and lower guide member includes a plurality of apertures sized and shaped for receiving a guide rod that includes a sharpening stone.

The first clamping member further defines at least one aperture that corresponds and mates with an equal number of protrusions on the sleeve member, the sleeve member sized and shaped for receiving the knife blade. In application, when the sleeve member is clamped between the first and second clamping members, mating the at least one aperture with the corresponding protrusions, and tightening the screws and thumb screw will assure the sleeve member with the knife blade therein is held firmly and in a reproducible position.

DESCRIPTION OF THE PREFERRED EMBODIMENT

Figure 1:
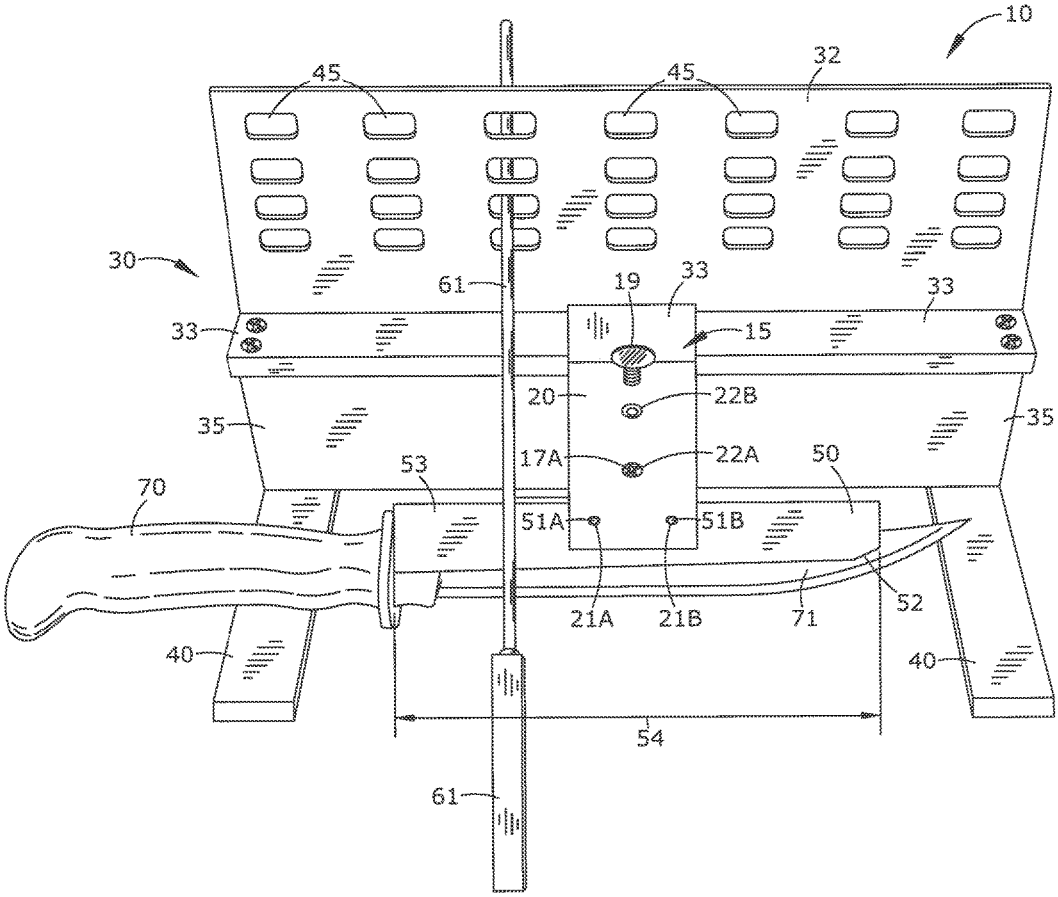
FIG. 1 is a top perspective view of the present invention, a knife sharpening device.

The present invention is directed to a knife sharpener for the manual sharpening of knives. The present knife sharpening device defines embodiments designed to assure a knife blade is being held firmly by the sharpener device and in an exact repeatable location. In the broadest context, the knife sharpening device of the present invention consists of components configured and correlated with respect to each other so as to obtain the desired objective.

Referring the drawings, a knife sharpening device 10 according to the preferred embodiment is shown. The sharpening device 10 generally includes a knife clamp member 15 that includes first and second clamping members 20 and 25, a guide member 30 that defines an upper guide member 32 and a lower guide member 35, and a base member 40.

A clamping member adjustment is used in order to engage the first and second clamping members into a clamping position. As illustrated, the knife clamp member 15 includes a pair of screws, designated as numerals 17A and 17B. Each of the pair of screws 17A, 17B downwardly extend through apertures 22A, 22B, respectively, in the first clamping member 20 and are each threadably received in a pair of bores 27A, 27B of the second clamping member 25.

As illustrated, the pair of screws 17A, 17B in application, are parallel with a length L (see FIG. 4) of guide member 30, and perpendicular to a longitudinal axis 5. As further illustrated, the knife clamp member 15 is parallel with the longitudinal axis 5, and therefore perpendicular to the length L of guide member 30.

The knife clamp member 15 preferably includes a thumb screw 19 that vertically extends through an aperture 21C in the first clamping member 20 and is received in a tapped bore 29 of the second clamping member 25. As will be understood, the pair of screws 17A, 17B as well as the thumb screw 19 for fixedly clamping a sleeve member 50 between the first and second clamping members 20, 25 to prevent the sleeve 50 from moving therein. The sleeve member 50 contoured for frictionally receiving a knife 70 having a blade 71 to be sharpened.

As illustrated, the upper guide member 32 upwardly extends from the knife clamp member 15 and the lower guide member 35 downwardly extends from the knife clamp member 15, with a ledge 33 therebetween. The lower guide member 35 joined to the base member 40.

Figure 4:
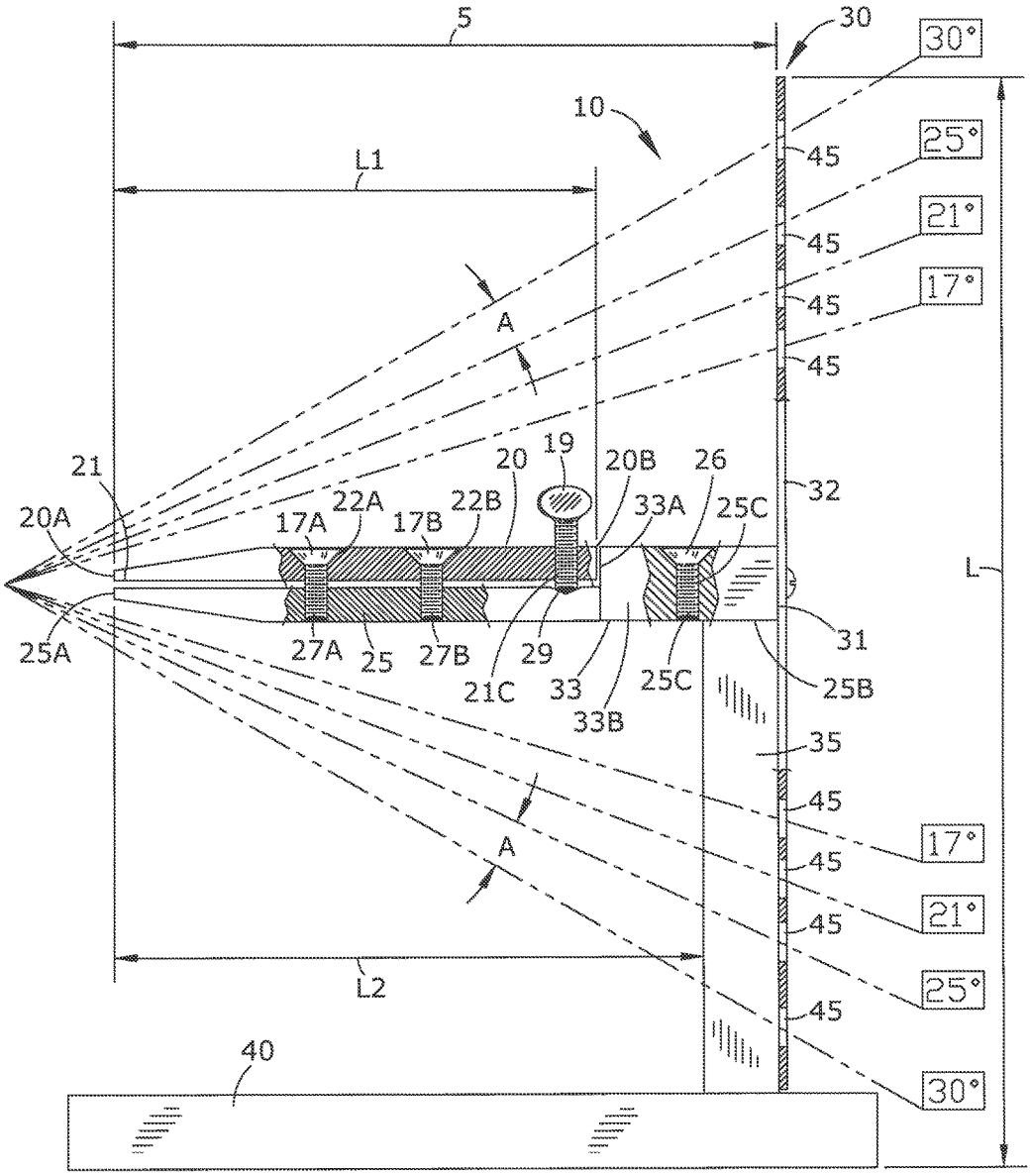
FIG. 4 is a side view of the knife sharpening device shown in FIG. 1.
Figure 5:
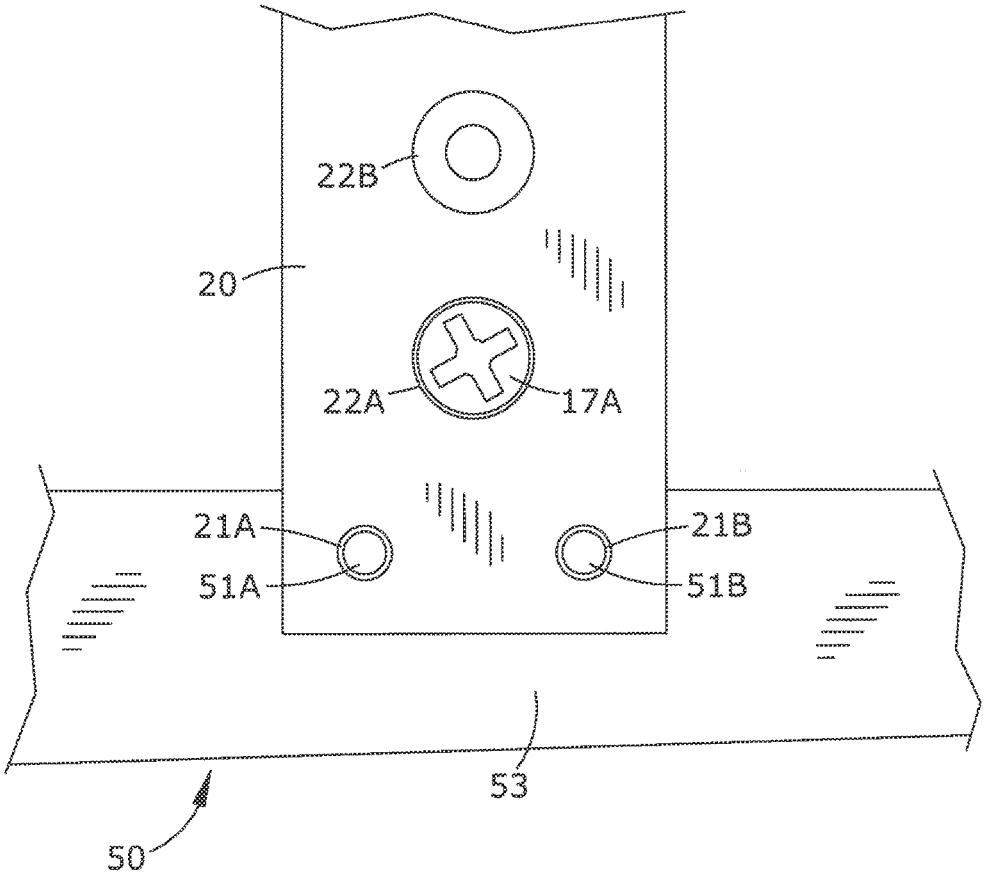
FIG. 5 is an exploded top view of the distal end of the knife clamp member with a sleeve member positioned therein.

Each guide member 32 and 35 includes at least two (2) columns of apertures 45 sized and shaped for receiving a guide 60 that includes a sharpening stone 61. As best shown in FIGS. 1, 4 and 5, and as is known in the art, by inserting the guide rod 60 in different apertures 45 the angle A (illustrated in FIGS. 4 and 5) of the sharpening stone relative to the knife edge 71 can be changed. Once the proper angle has been selected, the guide rod 60 will maintain the sharpening stone 61 at a substantially constant angular orientation relative to the knife edge 71 during the sharpening process.

As illustrated, each of the plurality of apertures 45 essentially have straight upper and lower sides and rounded ends. More specifically, aperture 45A (see FIG. 6) includes straight lower and upper sides 46 and 47, respectively, and rounded ends 48 and 49. All of the apertures 45 are preferably identical. The elongated aperture sides 46 and 47 can be of any desired length so as to permit the sharpener stone 61 to provide a desired range of operation when the guide rod 60 has been inserted through the proper aperture 45 and the sharpening stone 61 is caused to laterally traverse the knife edge 71.

Figure 3:
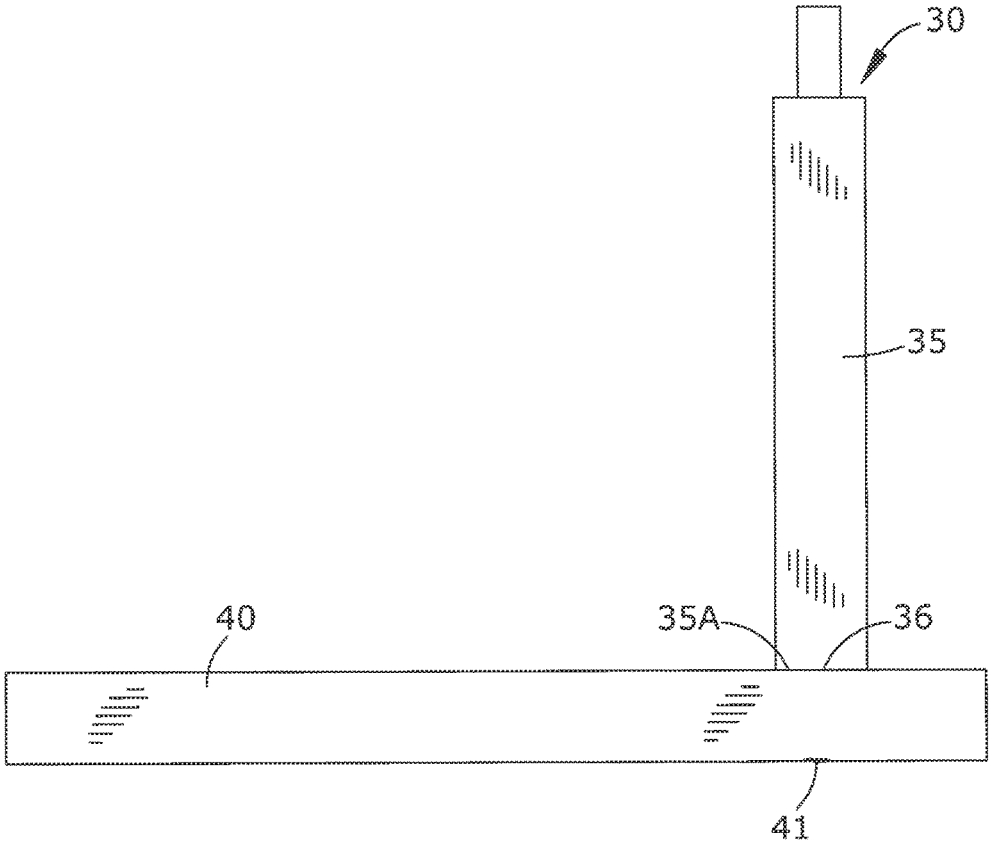
FIG. 3 is a side view of a second alternate configuration for attaching the lower guide member to the base member.

The guide member 30 may be integral to the base member 40 or separate and appropriately attached. As illustrated in FIG. 3, guide member 30 may be joined with base member 40 using a screw 41 that is threadably received in a bore 36 disposed at a lower most end 35A of the lower guide member 35.

Figure 2:
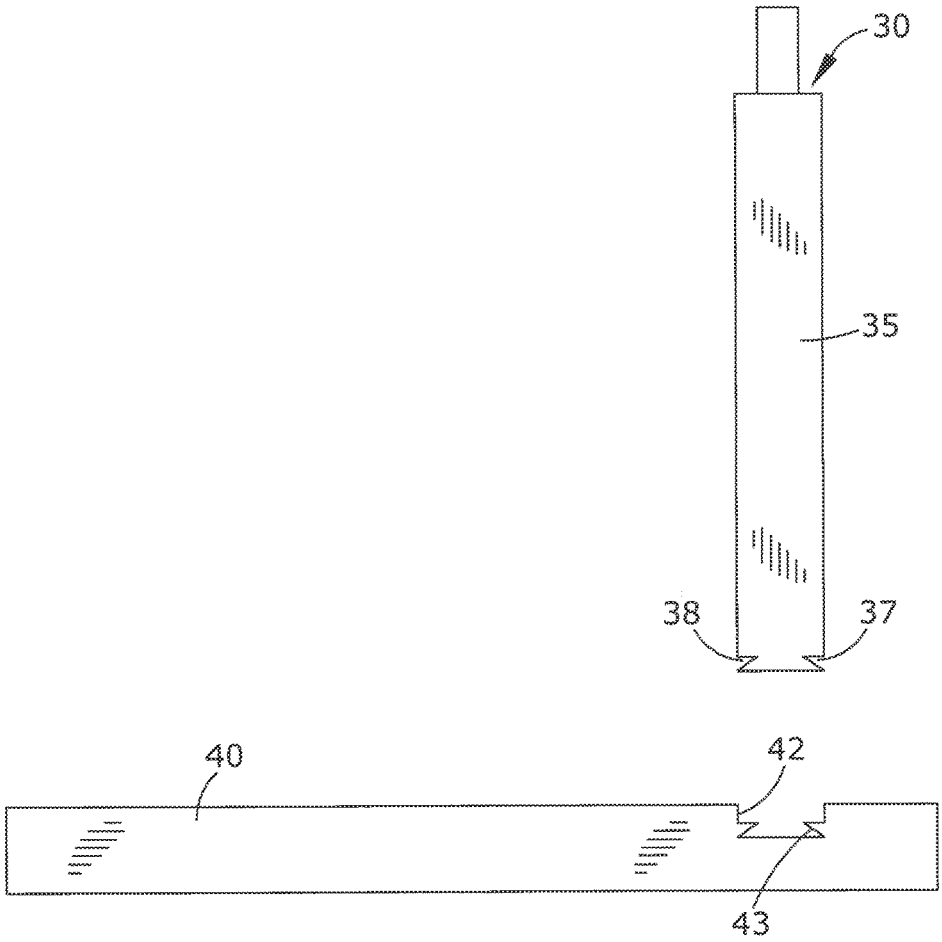
FIG. 2 is a side view of the lower guide member attached to the base member.

Referring to FIG. 2, base member 40 may define a notch 42 sized and shaped for releasably receiving a defined end 37 of lower guide member 35. Defined end 37 includes a catch 38 that aligns with and is received within a defined lower portion 43 of notch 42.

Referring again to the knife clamp member 15, as illustrated in FIG. 4, the first clamping member 20 further defines at least one aperture 21 which in application, will correspond and mate with an equal number of protrusions 51 on the sleeve member 50. The sleeve member 50 including a slit 52 that is sized and shaped for receiving the knife blade 71 or apparatus to be sharpened.

In application, when the sleeve member 50 is clamped between the first and second clamping members 20 and 25, mating the at least one aperture 21 with the corresponding protrusions 51 (and tightening the screws 17A, 17B and thumb screw 19 as described) will assure the sleeve member 50 with the knife blade 71 therein is held firmly and in a reproducible position.

As illustrated, the at least one aperture 21 and corresponding protrusions 51 having an oval or circular configuration, however, the apertures 21 and protrusions 51 can be of varying shapes and sizes.

Figure 6:
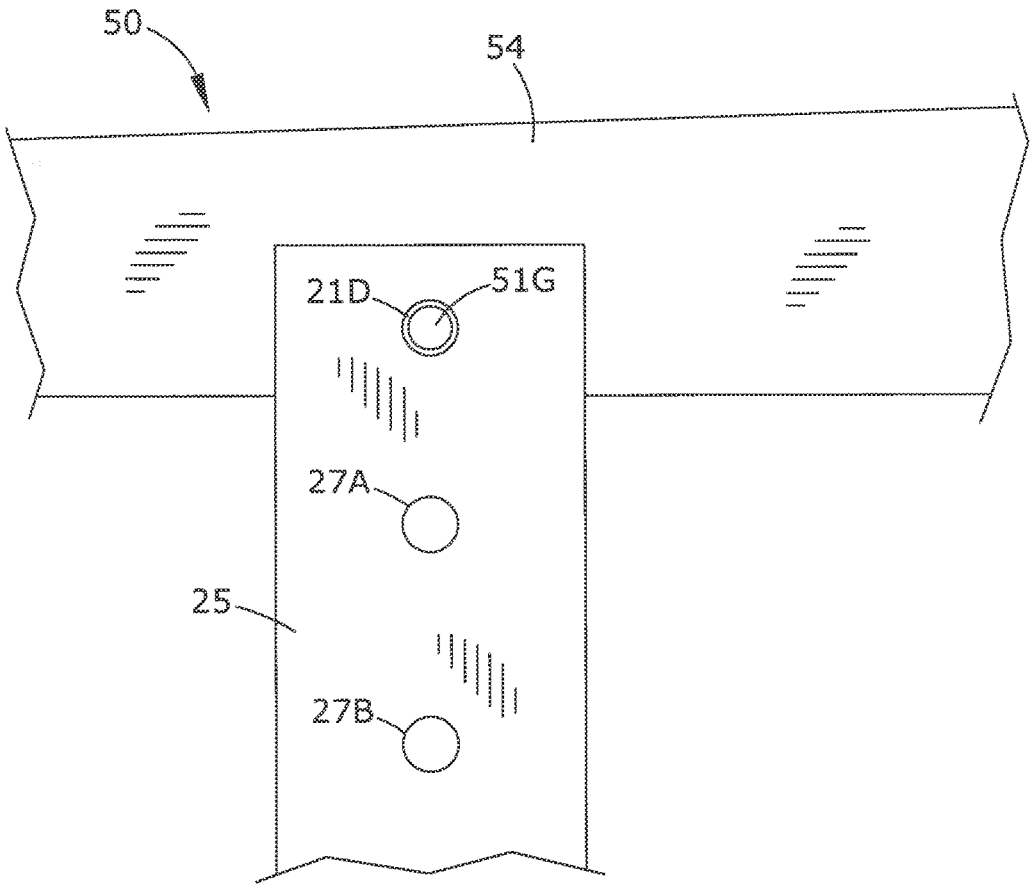
FIG. 6 is an exploded bottom view of the distal end of the knife clamp member with a sleeve member positioned therein.
Figure 7:
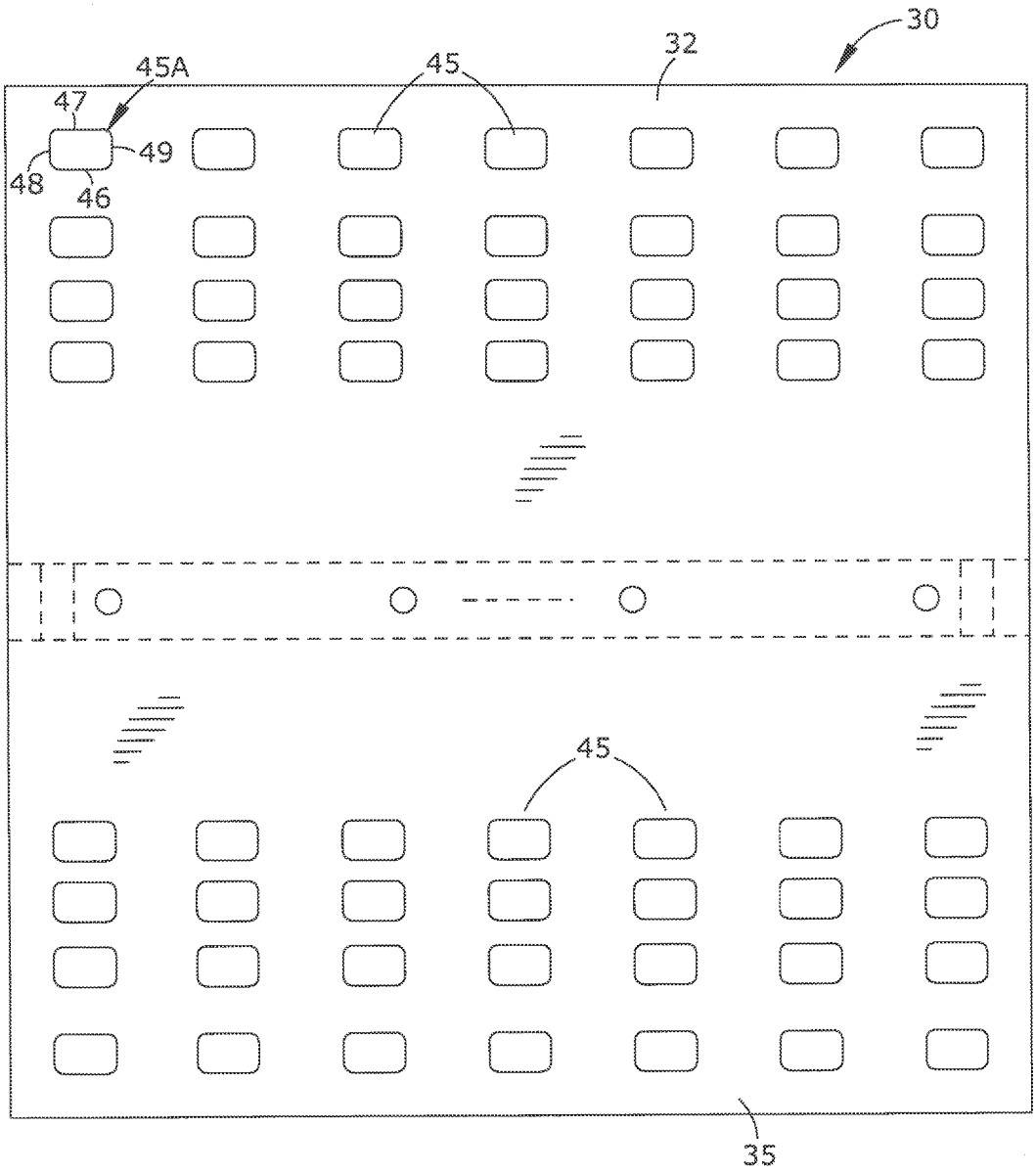
FIG. 7 is a front view of the guide member.
Figure 8:
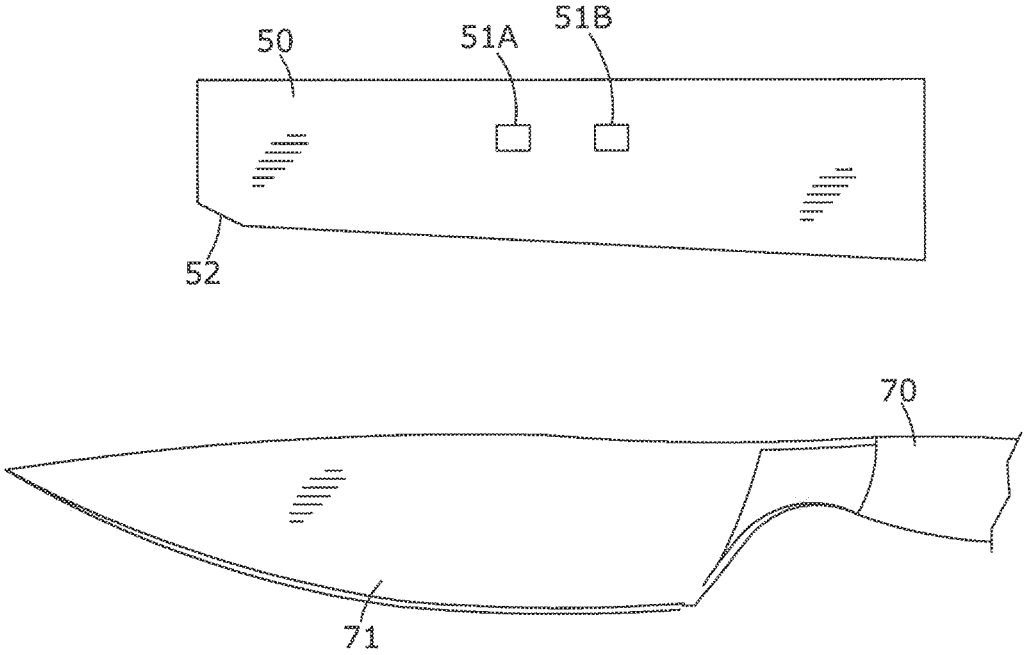
FIG. 8 is a top view of a sleeve member and corresponding knife with knife blade.

Referring to FIGS. 5 and 6, the sleeve member 50 preferably defines first and second upper protrusions designated as numeral 51A, 51B disposed on an upside 53 of the sleeve 50 that are received in the corresponding apertures 21A, 21B disposed on the first clamping member, and a single protrusion 51C disposed on a downside 54 of the sleeve 50 that downwardly projects through the corresponding aperture 21D of the second clamping member 25. Again, the sleeve member 50 having corresponding protrusions with the apertures of the first and second clamping members.

As should be understood, the benefit of the defined sleeve member 50 with at least one protrusion and corresponding apertures in the first and second clamping members not only assures that the sleeve member 50 with knife blade 71 is held securely but the sleeve member 50 with knife blade 71 is also held in a repeatable position which assures the knife blade 71 is being positioned between the first and second clamping members in the same position in which the knife blade was installed the last time it was sharpened. As a result, the embodiments of the present invention assures the knife blade can be precisely clamped in the exact position as previously honed ensuring the same precise angle of the knife blade's honed area is maintained.

As best shown in FIG. 4, first clamping member 20 defines a first length L1 that extends from a distal end 20A of first clamping member 20 to the ledge 33 of the guide member 30 such that the opposite end 20B of the first clamping member 20 abuts the front end 33A of the ledge 33. The second clamping member 25 defines a length L2 that extends from a distal end 25A of the second clamping member 25 and extends through a slot 33B in the ledge 33 such that an opposite end 25B of the second clamping member 20 abuts with the surface 31 of the guide member 30. The second clamping member 25 may include a screw 26 that vertically extends through an aperture on the opposite end 25B of the second clamping member 25 and is threadably received in a bore disposed in the ledge 33. In the alternative (shown in FIG. 4), the screw 26 may vertically extend through an aperture in the ledge 33 and is threadably received in a bore 25C disposed on the opposite end of the second clamping member.

As such, the second clamping member 25 is fixed to the guide member 30 and the first clamping member 20 configured to fasten to the fixed second clamping member 25. In application, the sleeve member 50 is positioned to the first and second clamping members as described and the first clamping member 20 is tightened to the second clamping member 25 with the screws 17A, 17B and thumb screw 19.

As illustrated, the sleeve member 50 defines a slit 52 that is sized and shaped for receiving the knife blade 71. Preferably, the slit 52 is custom made to frictionally receive the knife blade 71 and varies according to the shape of the knife blade. As illustrated, the slit 52 defines a slit length 54 that further varies according to the knife blade 71.

As should be understood, the benefit of the defined sleeve member 50 assures that the knife blade held within the sleeve member 51 and the sleeve member 50 are in a repeatable position which assures the knife blade is being positioned between the first and second clamping members in the same position in which the knife blade was installed the last time it was sharpened. As a result, the knife blade can be precisely positioned in the exact position as previously honed ensuring the same precise angle of the knife blade's honed area is maintained.

Although the description above contains many specificities, these should not be construed as limiting the scope of the invention but as merely providing illustration of some of the presently preferred embodiments of this invention. As such, it is to be understood that the present invention is not limited to the embodiments described above, but encompasses any and all embodiments within the scope of the claims.

It would be obvious to those skilled in the art that modifications may be made to the embodiments described above without departing from the scope of the present invention. Plus the scope of the invention should be determined by the dependent claims in the formal application and their legal equivalents, rather than by the examples given.

I claim:

1. A knife sharpening device comprising:

a knife clamp member that includes first and second clamping members, a guide member that includes an upper guide member and a lower guide member, a base member, and a sleeve member that defines a slit contoured for frictionally receiving a knife having a blade, said upper guide member upwardly extends from the knife clamp member and said lower guide member downwardly extends from the knife clamp member with a ledge therebetween, and wherein said lower guide member joined to said base member, and wherein said upper and lower guide members each including at least two (2) columns of apertures sized and shaped for receiving a guide that includes a sharpening stone, said first clamping member having a distal end that includes at least one aperture that mates with at least an equal number of protrusions on said sleeve member such that said sleeve member is selectively received between the first and second clamping members and fixedly secured with at least one tightening screw, and wherein said first clamping member defines a first length that extends from said distal end of said first clamping member to said ledge of the guide member such that an opposite end of the first clamping member abuts a front end of said ledge, and wherein said second clamping member defines a second length that extends from a distal end of the second clamping member and extends through an open slot disposed in a lower surface of said ledge such that an opposite end of said second clamping member abuts a frontal surface of the guide member, and wherein said opposite end of said second clamping member is appropriately attached to said ledge such that said second clamping member is fixed to said guide member and said first clamping member configured to tighten to said second damping member.

2. The knife sharpener of claim 1, wherein said sleeve member defines first and second upper protrusions that are received in corresponding first and second apertures disposed on said distal end of said first damping member, and a single protrusion downwardly projecting through a corresponding third aperture disposed on said distal end of said second damping member.

3. The knife sharpener of claim 1, wherein a damping screw vertically extends through a damp aperture disposed in said opposite end of said second damping member and is threadably received in a damp bore disposed in said ledge.

4. The knife sharpener of claim 1, wherein a damping screw vertically extends through a damp aperture disposed in said ledge and is threadably received in a bore disposed in said opposite end of said second damping member.

5. The knife sharpener of claim 1, wherein each of said at least one tightening screws pass through an aperture in said first damping member and are threadably received in a bore disposed in said second damping member.

6. The knife sharpener of claim 5, further defining a longitudinal axis, and wherein said at least one tightening screw is perpendicular to said longitudinal axis.

7. The knife sharpener of claim 6, further including a thumb screw that vertically extends through a thumb screw aperture in said first damping member and threadably received in a tapped bore of said second damping member.

8. The knife sharpener of claim 7, wherein each of said apertures in said at least two (2) columns of apertures have straight upper and lower sides and rounded ends.

9. The knife sharpener of claim 8, wherein said guide member is joined with said base member using a base screw that is threadably received in a lower bore disposed at a lower most end of said lower guide member.

10. The knife sharpener of claim 8, wherein said base member defines a notch sized and shaped for releasably receiving a defined end disposed at a lower most end of said lower guide member.

11. The knife sharpener of claim 10, wherein said defined end of said lower guide member includes a catch that aligns with a defined lower portion of said notch.

12. A knife sharpening device comprising:

a knife clamp member that includes first and second clamping members, a guide member, a base member, and a sleeve member that defines a slit contoured for frictionally receiving a knife having a blade, and wherein said lower guide member joined to said base member, and wherein guide member including at least two (2) columns of apertures sized and shaped for receiving a guide that includes a sharpening stone, said first clamping member having a distal end that includes at least one aperture that mates with at least an equal number of protrusions on said sleeve member such that said sleeve member is selectively received between the first and second clamping members and fixedly secured with at least one tightening screw, and wherein said first clamping member defines a first length that extends from said distal end of said first clamping member to a ledge of the guide member such that an opposite end of the first clamping member abuts a front end of said ledge, and wherein said second clamping member defines a second length that extends from a distal end of the second clamping member and extends through an open slot of said ledge such that an opposite end of said second clamping member abuts a frontal surface of the guide member, and wherein said opposite end of said second clamping member is appropriately attached to said ledge such that said second clamping member is fixed to said guide member and said first clamping member configured to tighten to said second clamping member.

13. The knife sharpener of claim 12, wherein said sleeve member defines first and second upper protrusions that are received in corresponding first and second apertures disposed on said distal end of said first damping member, and a single protrusion downwardly projecting through a corresponding third aperture disposed on said distal end of said second damping member.

14. The knife sharpener of claim 12, wherein said guide member includes an upper guide member and a lower guide member, and wherein said upper guide member upwardly extends from said knife damp member and said lower guide member downwardly extends from said knife damp member.

15. The knife sharpener of claim 12, wherein a damping screw vertically extends through a damp aperture disposed in said opposite end of said second damping member and is threadably received in a damp bore disposed in said ledge.

16. The knife sharpener of claim 12, wherein a damping screw vertically extends through a damp aperture disposed in said ledge and is threadably received in a bore disposed in said opposite end of said second damping member.

17. The knife sharpener of claim 12, wherein each of said apertures in said at least two (2) columns of apertures have straight upper and lower sides and rounded ends.

18. A knife sharpening device comprising:

a knife damp member that includes first and second damping members, a guide member, a base member, and a sleeve member that defines a slit contoured for frictionally receiving a knife having a blade, said second damping member having a distal end and an opposite end, said distal end includes at least one aperture that mates with at least an equal number of protrusions on a first side of said sleeve member such that said sleeve member is selectively received between the first and second damping members and fixedly secured with at least one tightening screw, wherein a distal end of said first damping member having at least one aperture that mates with at least an equal number of protrusions on a second side of said sleeve member, and wherein said opposite end is attached to a frontal surface of said guide member and said first clamping member is tightened to said second clamping member.

19. The knife sharpener of claim 18, wherein said first clamping member defines a first length that extends from a distal end of said first clamping member to a ledge of the guide member such that an opposite end of the first clamping member abuts a front end of said ledge, and wherein said second clamping member defines a second length that extends from said distal end of the second clamping member and extends through an open slot of said ledge such that said opposite end of said second clamping member abuts a said frontal surface of the guide member, and wherein said opposite end of said second clamping member is appropriately attached to said ledge such that said second clamping member is fixed to said guide member.

* * * * *